United States Patent [19]

Dragojevic

[11] 4,386,652

[45] Jun. 7, 1983

[54] HEAT EXCHANGE ASSEMBLY

[75] Inventor: Bozo Dragojevic, Downsview, Canada

[73] Assignee: North York Mobile Wash Limited, Downsview, Canada

[21] Appl. No.: 185,230

[22] Filed: Sep. 8, 1980

[30] Foreign Application Priority Data

Jun. 27, 1980 [CA] Canada ..... 355066

[51] Int. Cl.[3] ..... F28F 1/00; F28F 9/02; F28F 9/22; F28D 1/04

[52] U.S. Cl. ..... 165/144; 165/150; 165/176; 29/157.4

[58] Field of Search ..... 165/143–145, 165/150, 158, 176; 29/157.4

[56] References Cited

U.S. PATENT DOCUMENTS

| | | | |
|---|---|---|---|
| 145,591 | 12/1873 | Richardson | 165/157 |
| 397,130 | 2/1889 | Kelly | 29/157.4 |
| 667,809 | 2/1901 | Taege | 165/158 |
| 1,917,042 | 7/1933 | Lewis et al. | 165/176 |
| 1,936,166 | 11/1933 | Kendall | 165/176 |
| 2,044,457 | 6/1936 | Young | 165/144 |
| 2,419,575 | 4/1947 | Leonard | 165/158 |

FOREIGN PATENT DOCUMENTS 540404 5/1957 Canada .

*Primary Examiner*—William R. Cline
*Assistant Examiner*—John Kramer
*Attorney, Agent, or Firm*—Riches, McKenzie & Herbert

[57] ABSTRACT

A heat exchange assembly is disclosed, which assembly when placed, for example, in a temperature controlled environment, allows heat exchange between the environment and a fluid passed through the assembly. The heat exchange assembly comprises a plurality of elongated headers each having closed ends and longitudinally arranged inlet holes and outlet holes to provide fluid passage through the header from the inlet holes to the outlet holes transversely to the longitudinal. The headers are interconnected by tubes so that the fluid will pass sequentially through successive headers. Each header may advantageously be provided with a removable plate to allow insertion of cleaning reamers into the inside of the tubes. The heat exchange assembly is adapted to be constructed from readily available materials to form a self-supporting unitary structure.

7 Claims, 6 Drawing Figures

FIG. 1.
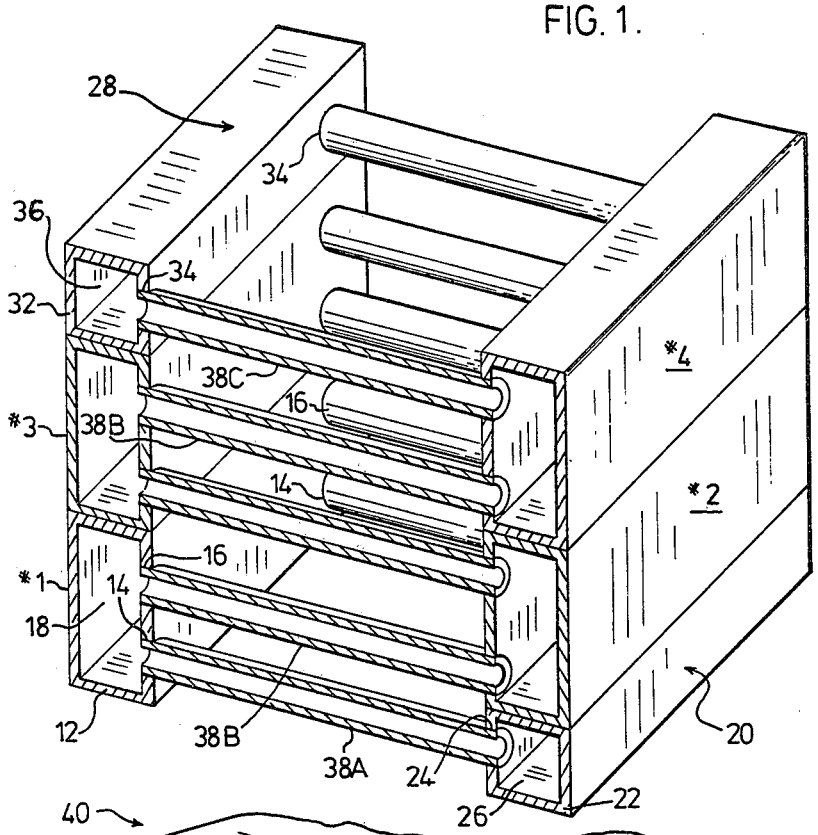
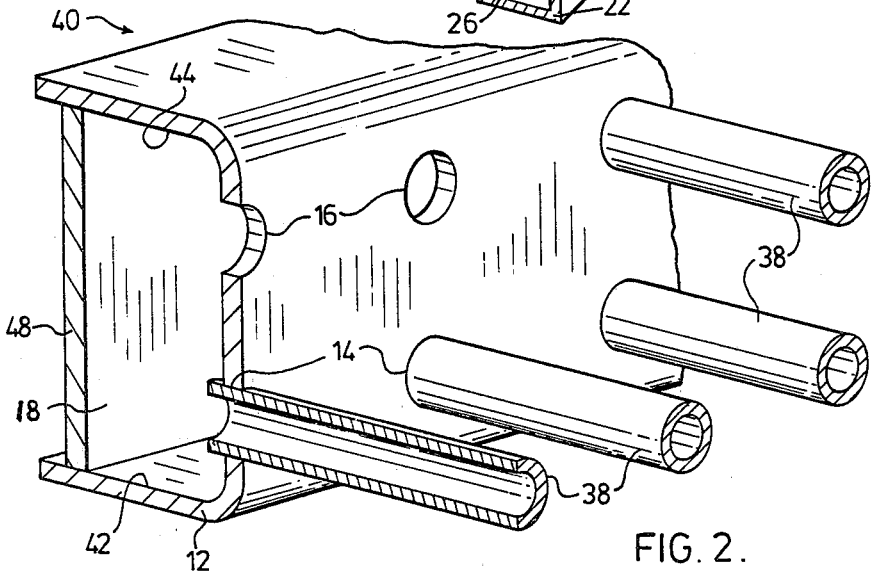
FIG. 2.

FIG. 5.
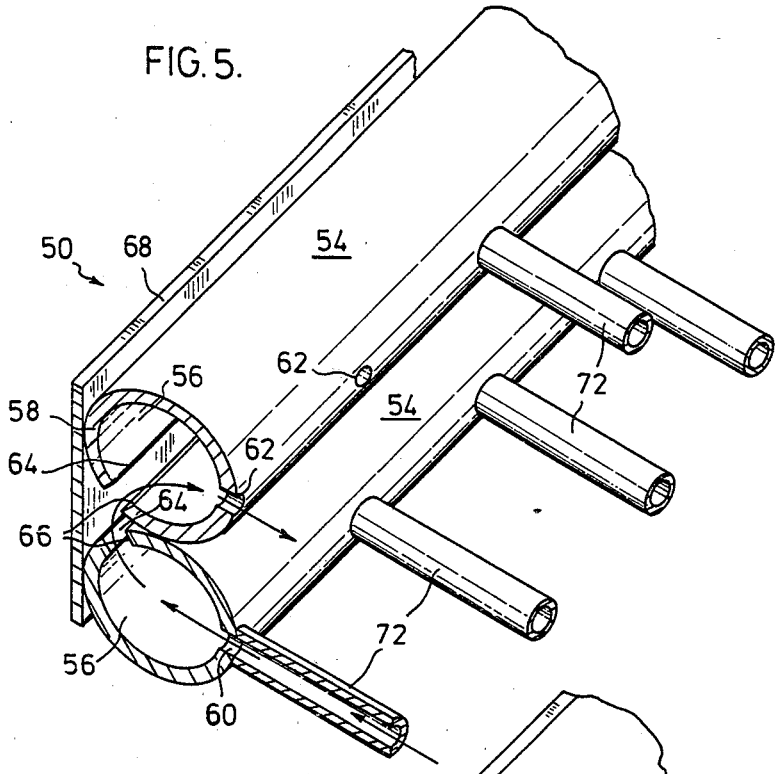
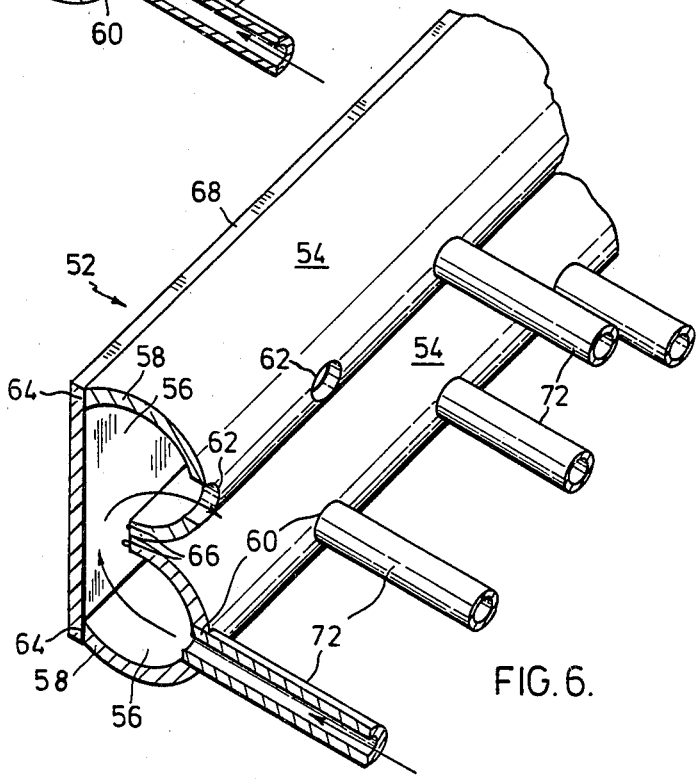
FIG. 6.

HEAT EXCHANGE ASSEMBLY

BACKGROUND OF THE INVENTION

This invention relates, generally, to an improved heat exchange assembly, and particularly to a heat exchange assembly having a novel arrangement of headers suitable for use with a novel header construction.

A myriad of heat exchange devices are known to supply heated water and steam for domestic, commercial, and industrial purposes. Factors which determine the suitability and costs of a heat exchange device for any given purpose include the device's operating or performance characteristics as well as the method and materials required for the device's manufacture, maintenance, and repair. For any given purpose, most heat exchange devices have technical disadvantages relating to at least one of their operation, manufacture, maintenance, or repair, while those devices which may be technically suitable are generally prohibitably expensive for the intended use.

Performance characteristics of a heat exchange device adapted to transfer heat to a fluid contained therein include characteristics such as start-up time, energy efficiency and heat output, thereby determining the quality and quantity of heated fluid which may be produced. Operations strictly dependent on hot water supply, such as car washing systems, may have special performance requirements not usually met by heat exchange devices. For example, car washing systems often operate intermittently requiring large volumetric flow rates for short time intervals and favouring fluid heating devices with small start-up times. However, most fluid heating devices designed for car washing systems either have excessively lengthy start-up times suitable only for continuous operation, or have adequate start-up times but low energy efficiencies.

Most known heat exchange devices suffer from the disadvantage that they are manufactured by sophisticated methods developed for use with specialized materials. These methods are generally incompatible with the use of more conventional materials such as standard commercial pipe and tubing. Repair to such devices must be carried out by skilled repairmen using expensive and frequently unavailable replacement parts. Few heat exchange devices exist in which repair may be easily affected by nominally skilled persons using readily available tools and materials. Notwithstanding these difficulties of repair, designs of heat exchange devices seldom facilitate or even permit effective maintenance which could eliminate many device failures and prolong device life as well as maintain device energy efficiencies.

The disadvantages of known heat exchange devices may be further illustrated by reference to coil water heater, typical of many conventional fluid heating devices which comprise a heat exchange assembly, in this case a coil, which along with a fuel burner may be located within a furnace enclosure. The coil, formed as a continuous single tube, is placed in the furnace enclosure so that water passing through the coil is heated by heat transferred through the walls of the coil from hot air produced in the furnace enclosure by the combustion of gas or oil in the burner. Such coil water heaters have the disadvantage that the coil is expensive to manufacture and, in the event of failure, must be replaced by a similarly expensive coil. In addition, to design coil water heaters with different performance characteristics, coils of different diameters and lengths are required. Increases in the dimensions of the coil greatly increase the relative cost of coil manufacture. As a further disadvantage, in maintenance, the curvature of the coil makes it difficult to insert cleaning snakes or reamers into the coil to effect proper cleaning and scale removal.

SUMMARY OF THE INVENTION

Accordingly, it is an object of the present invention to at least partially overcome these disadvantages by providing a heat exchange assembly comprising a novel arrangement of headers.

It is another object to at least partially overcome these disadvantages by providing a heat exchange assembly comprising a novel header construction.

It is a further object of this invention to provide a heat exchange assembly which is inexpensive to construct, facilitates maintenance and repair and may be manufactured and repaired with readily available materials.

It is a further object of this invention to provide a heat exchange assembly which is structurally self-supporting and may comprise a single mechanical unit thereby facilitating transport and repair.

It is a further object of this invention to provide a heat exchange assembly which is suitable for use in fluid heating devices to provide low start-up times, as well as good energy efficiencies and large fluid volume capacities.

To this end, in one of its aspects, the invention provides a heat exchange assembly to allow heat exchange with a fluid to pass through the assembly comprising: a plurality of headers sequentially numbered from a first header to a last header, each header being elongated and having sealed ends, a header wall with a longitudinal array of inlet holes and a longitudinal array of outlet holes therethrough, and an inner chamber defined by the sealed ends and the header wall through which communication is provided transverse to the longitudinal from the said inlet holes to the outlet holes; and a plurality of tubes consisting of connecting tubes, entrance tubes and departure tubes; wherein one end of an entrance tube is received in each of the inlet holes of the first header, one end of a departure tube is received in each of the outlet holes of the last header, and each outlet hole of each header other than the last header receives one end of a connecting tube the other end of which is received in an inlet hole of the next higher sequentially numbered header, whereby the fluid may pass from the entrance tubes through the headers in increasing numerical succession to the departure tubes.

In another aspect, the invention provides a heat exchange assembly to allow heat exchange with a fluid to pass through the assembly comprising: a plurality of headers sequentially numbered from a first header to a last header, each header being elongated and having sealed ends, and a header wall with a longitudinal array of inlet holes and a longitudinal array of outlet holes therethrough, the header wall further having at least one longitudinal slot therethrough closed by at least one plate member so that an inner chamber is defined by the sealed ends, the header wall and the at least one plate member through which inner chamber communication is provided transverse to the longitudinal from the inlet holes to the outlet holes; and a plurality of tubes consisting of connecting tubes, entrance tubes and departure tubes; wherein one end of an entrance tube is received in each of the inlet holes of the first header, one end of a departure tube is received in each of the outlet holes of the last header, and each outlet hole of each header other than the last header receives one end of a connecting tube the other end of which is received in an inlet hole of the next higher sequentially numbered header, whereby the fluid may pass from the entrance tubes through the headers in increasing numerical succession to the departure tubes.

In another aspect, the invention provides a heat exchange assembly to allow heat exchange with a fluid to pass through the assembly comprising: a plurality of headers sequentially numbered from a first header to a last header, each header being elongated, having sealed ends and comprising two pipes sealably and fixedly connected along their lengths to each other, each having an interior and a pipe wall, with a longitudinal array of inlet holes passing through the pipe wall of one of the two pipes and a longitudinal array of outlet holes passing through the pipe wall of the other of the two pipes, with each pipe wall further having a longitudinal placement of at least one inner hole therethrough, and with at least one plate member sealably affixed to both said pipes so that an inner chamber is defined by the sealed ends, the pipe walls, and the at least one plate member whereby fluid communication is provided through the chamber from the inlet holes to the outlet holes through the interior and the at least one inner hole of both pipes; and a plurality of tubes consisting of connecting tubes, entrance tubes and departure tubes; wherein one end of an entrance tube is received in each of the inlet holes of the first header, one end of a departure tube is received in each of the outlet holes of the last header, and each outlet hole of each header other than the last header receives one end of a connecting tube the other end of which is received in an inlet hole of the next higher sequentially numbered header, whereby the fluid may pass from the entrance tubes through the headers in increasing numerical succession to the departure tubes.

The present invention is a heat exchange assembly through which a fluid medium may be passed such that with the heat exchange assembly placed, as for example, in a temperature controlled environment, heat may be exchanged between the fluid passing through the assembly and the temperature controlled environment.

BRIEF DESCRIPTION OF THE DRAWINGS

Further objects and advantages of the invention will appear from the following description taken together with the accompanying drawings in which:

FIG. 1 is a pictorial view of a cross-sectional segment of a first embodiment of the heat exchange assembly of the invention;

FIG. 2 is a cross-section of a preferred embodiment of a header adapted for use with the first embodiment of the heat exchange assembly;

FIGS. 5 and 6 are cross-sections of embodiments of headers adapted for use with the second embodiment of the heat exchange assembly.

DESCRIPTION OF THE PREFERRED EMBODIMENTS

Figure 3:
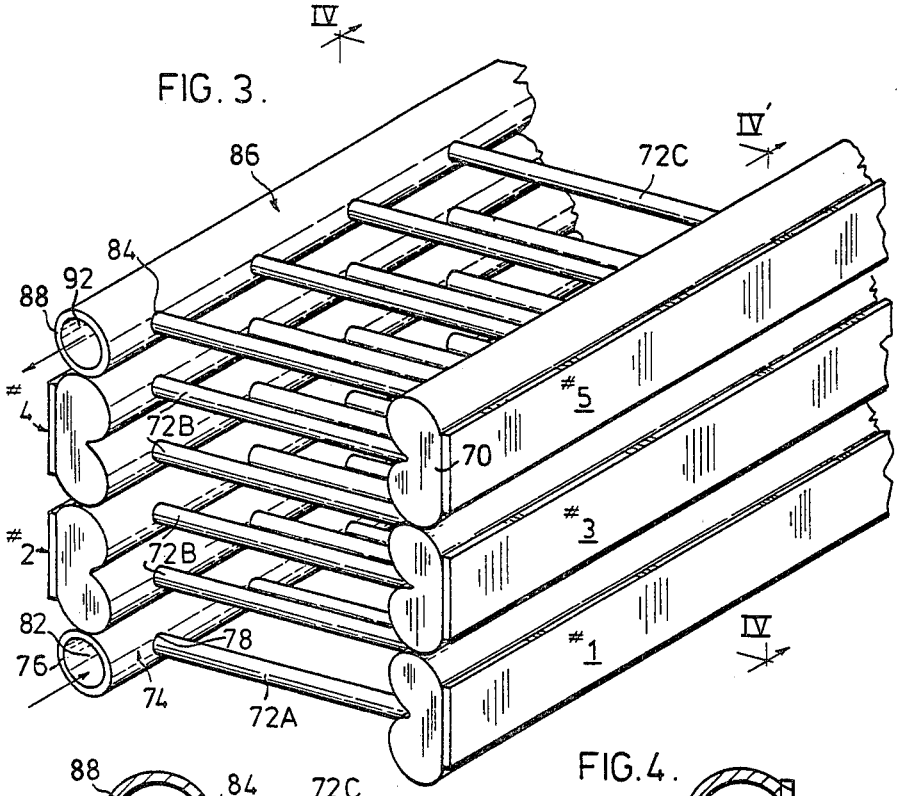
FIG. 3 is a pictorial view of a second embodiment of the heat exchange assembly.

Reference is made to FIG. 1 showing a first preferred embodiment of a heat exchange assembly according to this invention having four elongated headers positioned to be numbered from a first header #1 to a last header #4. Each header has a header wall 12 with a longitudinal array of inlet holes 14 and a longitudinal array of outlet holes 16 therethrough. Each header has sealed ends not shown in FIG. 1, but analogously represented as end closures 70 in FIG. 3 showing a second embodiment of the heat exchange assembly. The sealed ends and header wall 12 of each header define an inner chamber 18 through which communication is provided transversely to the longitudinal between inlet holes 14 and outlet holes 16.

Feeder pipe 20 has pipe wall 22 through which a longitudinal array of outlet holes 24 are provided. Feeder pipe 20 also has at least one major port (not shown), which port may be connected by conventional piping means (not shown) to a source of the fluid to be heated or cooled in the heat exchange assembly. Pipe wall 22 defines an inner chamber 26 through which communication is provided from the major port to outlet holes 24.

Collector pipe 28 has pipe wall 32 through which are provided a longitudinal array of inlet holes 34 and at least one major port (not shown), which port is connected by conventional piping means (not shown) with the destination of the fluid to be passed through the heat exchange assembly. Pipe wall 32 of collector pipe 28 defines an inner chamber 36 through which communication is provided from inlet holes 34 through inner chamber 36 to the major port of collector pipe 28.

Feeder pipe 20, headers #1 to #4 and collector pipe 28 are connected by tubes generally referred to as tubes 38 and specifically designated as entrance tubes 38A, connecting tubes 38B and departure tubes 38C. The embodiments of the heat exchange assembly preferably have tubes 38 which are straight tubes although, alternatively, curved tubes may be used.

Feeder pipe 20 is connected to the first header, header #1, by entrance tubes 38A, with one end of each entrance tube 38A being received in an outlet hole 24 of feeder pipe 20 and the other end of each entrance tube 38A being received in an inlet hole 14 of header #1. The outlet holes 16 of each header other than the last header, header #4 in FIG. 1, are connected to the inlet holes 14 of the next sequentially higher numbered header by connecting tubes 38B, one end of each connecting tube 38B being received in an outlet hole 16 of one header and the other end of each connecting tube 38B being received in an inlet hole 14 of the next sequentially higher numbered header. The last header is connected to collector pipe 28 by departure tubes 38C, with one end of each departure tube 38C being received in an outlet hole 16 of the last header and the other end of each departure tube 38C being received in an inlet hole 34 of collector pipe 28. The number of inlet holes and outlet holes of each of the feeder pipe 20, the headers, and the collector pipe 28 are established so that each inlet hole or outlet hole receives one end of a tube 38, the other end of which is received in an outlet hole or inlet hole of the appropriate feeder pipe 20, header or collector pipe 28.

In operation of the heat exchange assembly, a fluid medium to be heated or cooled is pumped under pressure through conventional piping means connecting the fluid source with the major port of the feeder pipe 20. The fluid passes through feeder pipe 20 and entrance tubes 38A, through the first header and successively through each successively higher numbered header via connecting tubes 38B to the last header, and through departure tubes 38C and collector pipe 28 to arrive at the fluid destination.

With the heat exchange assembly placed, for example, in a heated environment such as a furnace enclosure, hot air or other medium in the heated environment in contact with the outside surfaces of the heat exchange assembly may transfer heat through the headers, pipes and tubes of the assembly to a fluid contained in and passing through the heat exchange assembly. Alternatively, the heat exchange assembly may be adapted to cool the fluid contained in and passing through the heat exchange assembly.

FIG. 2 shows a preferred embodiment of a header 40 suitable for use with the first embodiment of the heat exchange assembly. Header 40 has sealed ends (not shown) and a header wall 12 with a longitudinal array of inlet holes 14 therethrough, a longitudinal array of outlet holes 16 therethrough, and a longitudinal slot therethrough from face 42 to face 44. Plate 48 sealably affixed to header wall 12 closes the longitudinal slot so that inner chamber 18 is defined by the sealed ends, header wall 12 and plate 48. The plate 48 may be removably affixed to header wall 12 to allow for access to inner chamber 18 of header 40 and to the inside of each tube 38 received by header 40, when plate 48 is removed, to facilitate cleaning of inner chamber 18 and the insides of tubes 38, and to facilitate repair or replacement of tubes 38. For example, with plate 48 removed, an elongated cleaning means such as a brush or reamer may be inserted through the longitudinal slot into tubes 38 to remove build up of scale and other precipitate throughout the entire length of each tube 38.

Header 40 may be constructed, for example, from readily available channel iron. Alternatively, rectangular tubing may be cut longitudinally to produce channel iron for two headers.

FIGS. 3 to 6 show a second embodiment of a heat exchange assembly according to the present invention with FIGS. 5 and 6 showing alternate embodiments of headers adapted for use with the second embodiment of the heat exchange assembly.

Header 50 in FIG. 5 and header 52 in FIG. 6 each comprise two pipes 54 sealably and fixedly connected along their lengths to each other. Each of pipes 54 has an interior 56 and a pipe wall 58. A plurality of longitudinally arranged inlet holes 60 pass through pipe wall 58 of one of the pipes 54 and a plurality of longitudinally arranged outlet holes 62 pass through pipe wall 58 of the other of the pipes 54. A longitudinal elongate aperture is cut out of pipe wall 58 from face 64 to face 66 throughout the entire length of pipe 54. Each aperture is located in pipe wall 58 so that plate 68 may be sealably affixed to each pipe 54 on the side of the aperture farthest from the other pipe 54 to close both apertures thereby forming an inner chamber including the interiors 56 of both pipes 54. With each header 50 and 52 having its ends sealed by end closures 70, the inner chamber is defined by end closures 70, a header wall comprising pipe walls 58 of both pipes 54 and plate 68. Thus, the inner chamber of headers 50 or 52 provides communication between inlet holes 60 of one pipe 54, through interior 56 and elongate aperture of that pipe, through the elongate aperture and interior 56 of the other pipe 54 to the outlet holes 62 of the other pipe.

Tubes generally designated as 72, only partially shown in FIGS. 5 and 6, have one end thereof sealably received by inlet holes 60 or outlet holes 62. FIG. 5 shows the ends of each tube 72 sealably received in a butting relationship with the inlet or outlet hole while FIG. 6 shows each end of tube 72 sealably received inside each inlet or outlet hole.

Figure 4:
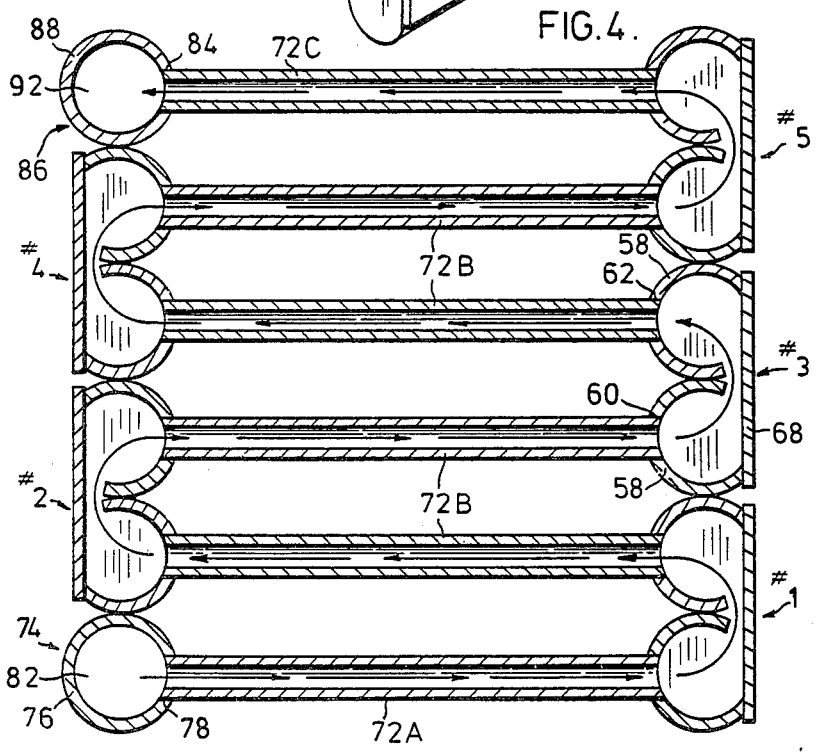
FIG. 4 is a cross-section of the heat exchange assembly of FIG. 3 through section IV—IV'.

FIGS. 4 and 6 show embodiments of headers in which plate 68 may be removably affixed to each pipe 54 to allow for access to the interior 56 of each pipe 54 and to the inside of each tube 72 when plate 68 is removed.

FIGS. 5 and 6 show embodiments with elongate apertures through pipe wall 58. Alternatively, headers 50 and 52 may be provided with a plurality of longitudinally arranged inner holes through pipe wall 58, with the inner holes being, for example, circular holes with diameters equal to the distance between faces 64 and 66 of pipe wall 58. To facilitate cleaning in the header of FIG. 6, but with inner holes, the inner holes may be placed in pipe wall 58 in opposing relationship to the inlet or outlet holes, so as to allow co-linear extension of cleaning means through the inner hole into a corresponding tube 72 when plate 68 has been removed.

FIG. 3 shows a complete heat exchange assembly according to the second embodiment of this invention. Feeder pipe 74 has pipe wall 76 with outlet holes 78 therethrough. An inner chamber provides communication between major port 82 and departure tubes 72A. Five headers are shown from a first header, header #1, to a last header, header #5. The headers have sealed ends closed by end closures 70 and are interconnected by connecting tubes 72B. The last header is connected by departure tubes 72C to inlet holes 84 of collector pipe 86, also having pipe wall 88, an inner chamber and major port 92. As shown by the arrows in FIGS. 3 and 4, fluid entering the heat exchange assembly via major port 82 of feeder pipe 74 passes successively through each header in a direction transverse to the longitudinal to exit through major port 92 of collector pipe 86.

As shown in FIGS. 1 and 3, each even numbered header may be affixed along its length to the next sequentially even numbered header, to form a bank of even numbered headers. Similarly, each odd numbered header may be affixed along its length to the next sequentially odd numbered header, to form a bank of odd numbered headers. Fixedly joining the headers to each other along their length provides a strong self-supporting heat exchange assembly with two banks of headers interconnected by straight tubes. FIG. 1 shows the feeder pipe and collector pipe affixed to different banks of headers, while FIG. 3 shows the feeder pipe and collector pipe both affixed to the same bank of headers. Other configurations of the headers, feeder pipe and collector pipe may also be advantageous, as for example, by staggering or offsetting the location of alternate headers in each bank.

The sizes, lengths, and numbers of headers and tubes may be varied to provide heat exchange assemblies of varying sizes and capacities to meet varying needs, and to allow insertion into various heating and cooling enclosures.

The relative parts of each heat exchange assembly may be joined to each other by conventional means. For example, in header 40 shown in FIG. 2, plate 48 and tubes 38 may be welded to pipe wall 12. In headers 50 and 52 shown in FIGS. 5 and 6, pipes 54 may be sealably affixed to each other by longitudinal welds running between pipes 54. Plate 68 may similarly be affixed to each pipe 54 by a longitudinal weld or, alternatively, plate 68 may be affixed in a manner to allow easy removal, as for example, by screws connecting plate 68 to each pipe 54, thereby sealably impinging a gasket means therebetween.

Although the description of this invention has been given with respect to particular embodiments, it is not to be construed in a limiting sense. Many variations and modifications will not occur to those skilled in the art. For definition of the invention, reference is made to the appended claims.

What I claim is:

1. A heat exchange assembly to allow heat exchange with a fluid to pass through said assembly comprising:

(a) a plurality of headers sequentially numbered from a first header to a last header, each header being elongated, having sealed ends, and comprising two pipes of circular cross-section sealably and fixedly connected along their lengths to each other at a single line of contact, each having an interior and a pipe wall, a longitudinal array of inlet holes passing through said pipe wall of one of said two pipes and a longitudinal array of outlet holes passing through said pipe wall of said other of said two pipes, with each pipe wall further having an elongate aperture therethrough running throughout the entire length of the pipe; and at least one plate member sealably affixed to both said pipes so that an inner chamber is defined by said sealed ends, said pipe walls, and said at least one plate member whereby fluid communication is provided through said chamber traverse to the longitudinal from said inlet holes to said outlet holes through said interior and said elongate aperture of both pipes, (b) a plurality of tubes consisting of connecting tubes, entrance tubes and departure tubes, wherein one end of an entrance tube is received in each of the inlet holes of the first header, one end of a departure tube is received in each of the outlet holes of the last header, and each outlet hole of each header other than the last header receives one end of a connecting tube the other end of which is received in an inlet hole of the next higher sequentially numbered header, whereby said fluid may pass from said entrance tubes through said headers in increasing numerical succession to the departure tubes.

2. A heat exchange assembly as claimed in claim 1 wherein each odd numbered header is fixedly joined along its length to the next sequentially numbered odd header and each even numbered header is fixedly joined along its length to the next sequentially numbered even header.

3. The heat exchange assembly of claim 1 wherein said connecting tubes are straight connecting tubes.

4. The heat exchange assembly as claimed in claim 3 wherein said at least one plate member is removable.

5. The heat exchange assembly as claimed in claim 1 wherein said longitudinal elongate aperture, each said inlet hole of one of said two pipes and the tubes received therein are arranged to permit co-linear extension of a straight cleaning means through the longitudinal elongate aperture and the inlet hole into the tube when the at least one plate member is removed.

6. A heat exchange assembly as claimed in claim 5 wherein said longitudinal elongate aperture, each said outlet hole of the other of said two pipes and the connecting tube received therein are arranged to permit co-linear extension of a straight cleaning means through the longitudinal elongate aperture and the outlet hole into the tube when the at least one plate member is removed.

7. A header for a heat exchange assembly comprising two elongate pipes of circular cross-section sealably and fixedly connected along their lengths to each other at a single line of contact, each pipe having an interior and a pipe wall, each pipe having a longitudinal array of holes passing through its pipe wall, each pipe further having an elongate aperture through its pipe wall extending throughout the length of the pipe an elongate, planar plate member sealably affixed to both said pipes so that an inner chamber is defined by said pipe walls and said plate member whereby fluid communication is provided through the chamber transverse to the longitudinal from the holes of one pipe to the holes of the other pipe in succession through the interior and elongate aperture of said one pipe and through the elongate aperture and interior of said other pipe.

* * * * *